United States Patent [19]

Wherry et al.

[11] Patent Number: 4,624,223

[45] Date of Patent: Nov. 25, 1986

[54] ROCKER ARM AND METHOD OF MAKING SAME

[75] Inventors: Joseph L. Wherry, Perrysburg; Ramanlal L. Patel, Maumee, both of Ohio

[73] Assignee: Toledo Stamping & Manufacturing Company, Toledo, Ohio

[21] Appl. No.: 762,335

[22] Filed: Aug. 5, 1985

Related U.S. Application Data

[63] Continuation of Ser. No. 412,102, Aug. 27, 1982, abandoned, which is a continuation-in-part of Ser. No. 134,447, Mar. 27, 1980, Pat. No. 4,346,678.

[51] Int. Cl.[4] ..... F01L 1/18

[52] U.S. Cl. ..... 123/90.44; 123/90.36; 29/156.7 B

[58] Field of Search ..... 123/90.39, 90.44, 90.36; 29/156.7

[56] References Cited

U.S. PATENT DOCUMENTS

| | | | |
|---|---|---|---|
| 2,272,166 | 2/1942 | Leake | 123/90.39 X |
| 3,096,749 | 7/1963 | Davidson | 123/90.39 |
| 3,502,058 | 3/1970 | Thompson | 123/90.36 X |
| 3,563,216 | 2/1971 | Uemura | 123/90.44 |
| 3,855,981 | 12/1974 | Loon | 123/90.44 X |

*Primary Examiner*—William R. Cline
*Assistant Examiner*—Peggy Neils
*Attorney, Agent, or Firm*—Allen D. Gutchess, Jr.

[57] ABSTRACT

A rocker arm and method of making same are provided. The rocker arm is of the cam-follower type and includes a metal body preferably made from a stamped metal piece and a stamped metal strip. A rounded recess is formed at one end portion of the metal piece and facing away from the metal strip to receive a lifter post having an end on which the rocker arm can pivot. The metal piece also has an additional recess at another end portion to receive an end of a valve stem and the metal strip has an intermediate convex portion facing away from the metal piece. The metal piece has a hole extending therethrough and communicating with the rounded recess, while the strip forms an oil passage communicating with the hole and extending toward the convex portion to supply lubricating fluid between the convex portion and the rounded recess. The convex portion has a shallow recess in which is received a hardened metal insert to be engaged by a cam. A softer metal layer is preferably in the shallow recess below the hardened insert. The insert is preferably affixed in the shallow recess by laser welding the ends of the insert to edges of the shallow recess.

3 Claims, 8 Drawing Figures

ROCKER ARM AND METHOD OF MAKING SAME

This is a continuation of application Ser. No. 412,102, filed Aug. 27, 1982, now abandoned, which is a continuation-in-part of U.S. application Ser. No. 134,447, filed Mar. 27, 1980, now U.S. Pat. No. 4,346,678.

This invention relates to a rocker arm of the cam-follower type and to a method of making same.

The present invention provides a rocker arm of the cam-follower type which is preferably made from a stamped metal piece and a stamped metal strip. The new rocker arm is strong and yet lighter in weight than many of those heretofore known. The rocker arm is also low in cost and requires minimum machining operations.

A first, rounded recess is formed in one end portion of the stamped metal piece and a second recess is formed in another end portion of the metal piece. The first, rounded recess receives the upper end of a lifter post while the other recess receives an end of a valve stem. A convex portion is formed on an intermediate portion of the stamped strip and faces away from the metal piece. The convex portion is designed to be engaged by a cam so that the rocker arm can operate the valve stem with the lifter post being a pivot.

The convex portion has a shallow recess therein which receives a hardened metal insert to be engaged by the cam. A softer metal layer preferably is located in the bottom of the shallow recess beneath the hardened insert. This layer provides a "cushion" which can deform to make up any distortion between the hardened insert and the rocker arm body. The softer layer also provides firm support and helps to position the insert properly relative to the body, the insert being struck or upset after it is in position. The insert is affixed to the metal body preferably by laser welding ends of the insert to corresponding edges of the shallow recess.

A lubricating hole is formed in the rounded recess and extends through the metal piece. An oil passage is formed in the strip and communicates at one end portion with the convex portion of the strip and at the other end portion with the lubricating hole. In this manner, lubricating fluid supplied through the cam flows down the passage into the hole to provide lubricating for the rounded recess and the upper end of the lifter post. Lubricating fluid can also be supplied in the opposite direction to the convex surface.

It is, therefore, a principal object of the invention to provide a rocker arm having the features and hardened insert discussed above.

Another object of the invention is to provide a method of making the rocker arm.

Other objects and advantages of the invention will be apparent from the following detailed description of a preferred embodiment thereof, reference being made to the accompanying drawings, in which.

Figure 2:
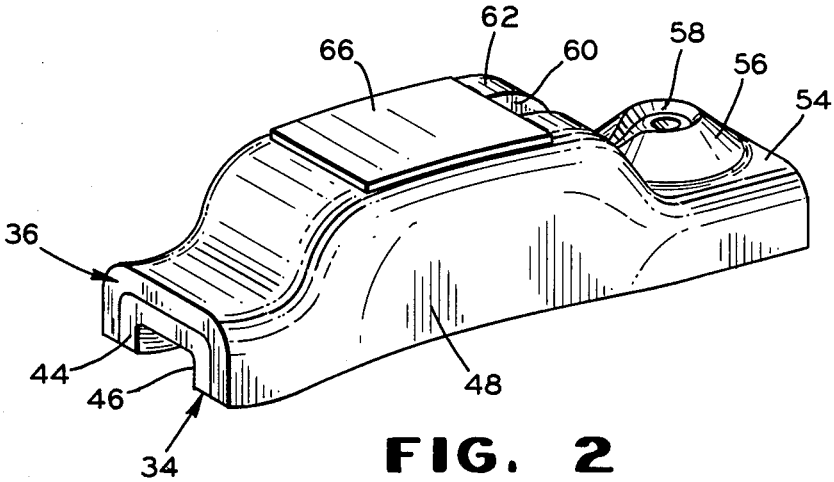
FIG. 2 is an enlarged view in perspective of the rocker arm of FIG. 1.
Figure 3:
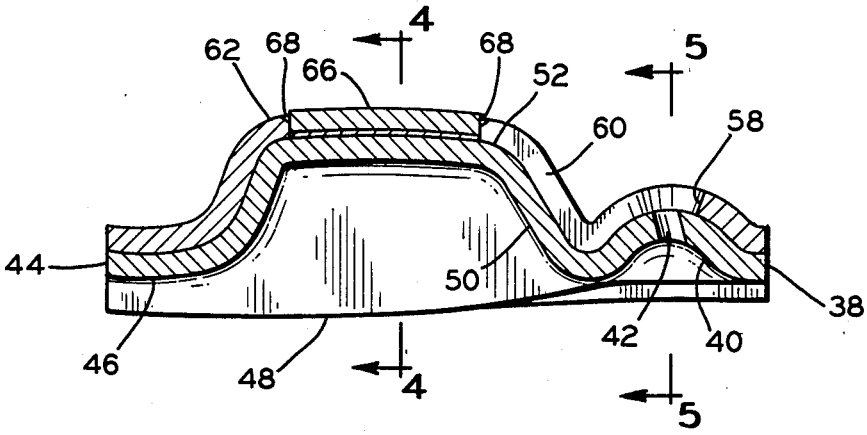
FIG. 3 is a view in longitudinal cross section taken through the rocker arm of FIG. 2.
Figure 4:
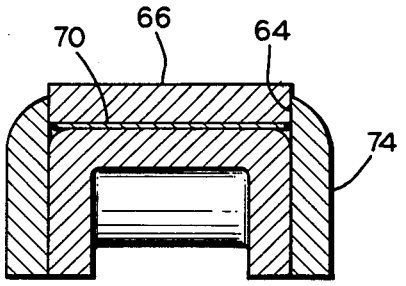
Figure 5:
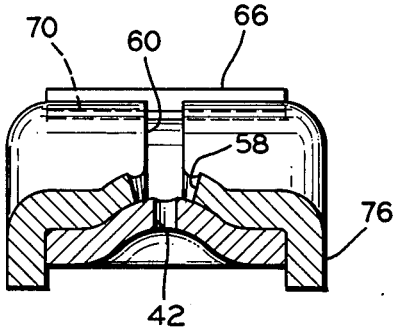
Figure 6:
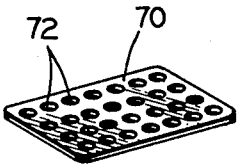
Figure 7:
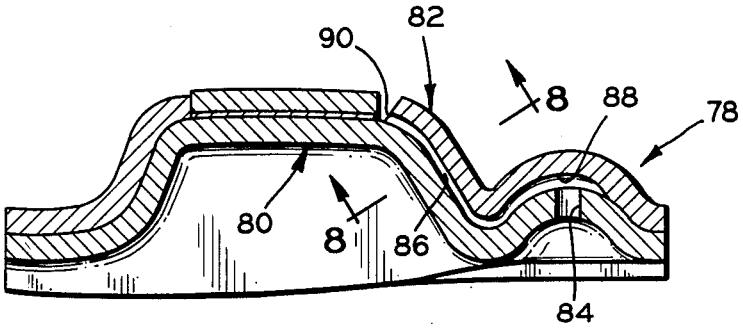
Figure 8:
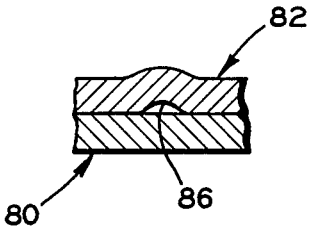

FIGS. 4 and 5 are views in transverse cross section taken along the lines 4—4 and 5—5 of FIG. 2;

FIG. 6 is a view in perspective of a soft metal layer used beneath a hardened metal insert of the rocker arm;

FIG. 7 is a view in longitudinal cross section taken through a modified rocker arm; and FIG. 8 is a view in transverse cross section taken along the line 8—8 of FIG. 7.

Figure 1:
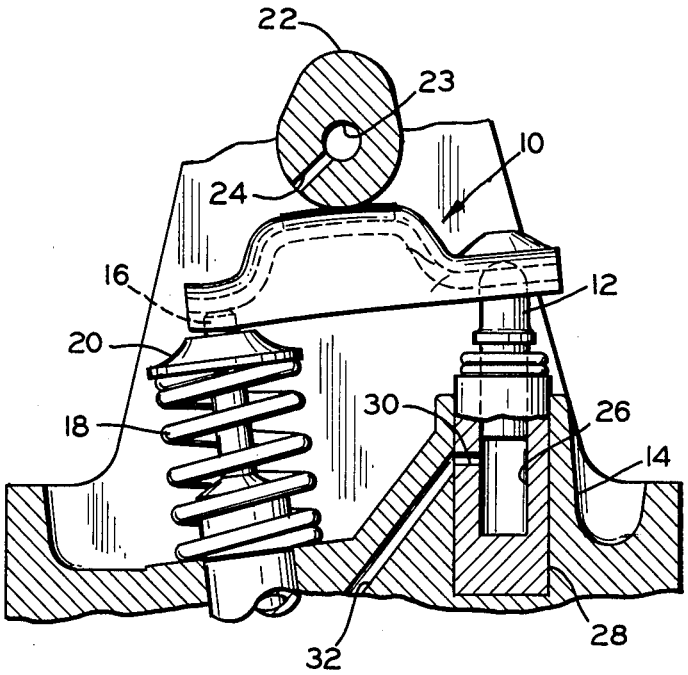
FIG. 1 is a somewhat schematic view in cross section, with portions in elevation, of valve actuating mechanism including a rocker arm in accordance with the invention.

Referring particularly to FIG. 1, a rocker arm of the cam-follower type is indicated at 10 and has one end received on a rocker arm fulcrum or lifter post 12 extending upwardly from a cylinder head 14 of an internal combustion engine. The other end portion of the rocker arm 10 engages an upper end of a valve stem 16. The valve stem extends upwardly from the cylinder head 14 through a coiled compression spring 18 located therearound and which is seated against the cylinder head and against a retainer seat 20 mounted on the stem 16. An overhead cam 22 engages an intermediate portion of the rocker arm 10 to cause a valve located at the lower end of the valve stem 16 to open and close as the stem is moved longitudinally by the rocker arm 10. Oil or other lubricating fluid is supplied through a central passage 23 in the cam shaft of the cam 22 and to a transverse passage 24 from which it flows to the intermediate surface of the rocker arm 10 for lubricating purposes.

The lifter post or fulcrum 12 is slidably carried in a chamber 26 of a cylinder 28. The post 12 is urged upwardly by fluid such as oil under pressure in the chamber 26 which is supplied through a small port 30 from a supply passage 32. The post 12 thereby can yield somewhat when the cam 22 is rotated. In practice, the post 12 moves down slightly at the high lobe of the cam 22 to provide a zero lash adjustment for the rocker arm 10. The port 30 is of a size to provide for controlled leakage of the oil from the chamber 26 to control pressure of the oil therein. Oil can also be supplied from the passage 32 up to the intermediate surface of the rocker arm 10 for lubricating purposes.

Referring more particularly to FIGS. 2-5, the rocker arm 10 includes a metal body which preferably is made from a stamped metal piece or part 34 and a stamped metal strip or part 36. The right end of the metal piece 34 has an end portion 38 in which is formed a first, rounded recess 40 to receive the upper rounded end of the lifter post 12. A lubricating hole 42 extends through the end portion 38 of the piece 34 to supply lubricant to the surfaces of the recess 40 and the post 12. Another end portion of the piece 34 has a recess 46 formed therein to receive the upper end of the valve stem 16. An intermediate portion 48 of the metal piece 34 has a deep void 50 formed therein with a generally convex upper surface 52.

The stamped metal strip or part 36 has an end portion 54 with a truncated conical projection 56 extending upwardly therefrom and forming an enlarged end or reservoir 58 of a groove or passage 60 formed in the part 36. The groove 60 extends from the end 58 upwardly to an intermediate, convex surface 62 at an intermediate portion of the rocker arm part 36 and facing away from the metal piece 34. The groove 60 can be formed in the part 36 alone or it can, as shown, be formed as a slot in the part 36 with the bottom formed by the upper surface of the metal piece 34. In either event, the lubricating fluid or oil supplied from the passage 24 to the convex surface 62 can flow down the groove 60, into the reservoir 58, and through the hole 42 to supply lubrication for the recess 40 and the upper end of the post 12. Of course, lubricant from the passage 24 also lubricates the surfaces of the cam 22 and the convex surface 62. Lubricant can also be supplied in the other direction.

A shallow recess 64 is formed in the convex surface 62 of the part 36. As shown, the recess 64 is formed by a rectangular opening in the part 36 with the bottom being the upper surface 52 of the metal piece 34. A long-wearing, hard metal insert 66, preferably of powdered metal, such as a hard or hardened iron alloy, is positioned in the shallow recess 64 and is affixed therein. This can be accomplished by electron beam welds or by brazing using localized heat by induction or laser heating. However, the insert is preferably affixed by laser welding at the ends thereof, producing welded joints 68 in FIG. 3. The laser welding produces extremely localized heating which will not destroy the hardness of the insert or that of the part 36 and piece 34.

Preferably, a metal layer or sheet 70 is located in the recess 64 below the insert 66 and is of a softer metal than the insert 66. The layer 70 can also have perforations 72 therein, as shown in FIG. 5, to aid in the deformation of this layer. After the layer 70 and the insert 66 are placed in the shallow recess 64, a uniform pressure is applied to the assembly to increase the dimensional accuracy of the insert relative to the metal piece 34 by a striking or upsetting operation. The layer 70 deforms during this operation to act as a "cushion" between the hard components to accommodate any distortion between parts and to provide a firm support for the insert. The parts are then clamped together and the insert affixed to the metal body by the techniques discussed above.

In the method of making the rocker arm 10, the metal piece 34 and the metal strip 36 are partially formed and are then assembled and affixed together, preferably by brazing. After piercing of the hole 42, additional coining operations are performed with the parts together and they are hardened. The part 36 has downwardly-extending sides 74 and 76 extending down around the piece 34 so that the piece and the strip are received in telescoping relationship, in which position they are maintained during the brazing operation. The hard insert 66 can be finish ground prior to assembly with the metal body, and additional grinding should not be necessary after assembly.

A slightly modified rocker arm is indicated at 78 in FIGS. 7 and 8. This rocker arm is particularly designed for use in an application where oil is supplied from the passage 32 up to the intermediate surface of the rocker arm insert 70 which is engaged by the cam 22. The rocker arm 78 includes a stamped metal piece or part 80 and a stamped metal strip or part 82. The part 80 is similar to the part 34 but has a vertical lubricating hole 84 therein.

The upper part 82 has an enclosed groove or passage 86 formed in the lower surface thereof and terminating in an enlarged cavity 88 above the hole 84. The upper end of the passage 86 terminates in an outlet opening 90 adjacent the insert 70. In this manner, the oil or other lubricant can be supplied under pressure through the hole 84, the cavity 88, the passage 86, and the outlet opening 90 to the upper surface of the insert 70.

Various modifications of the above-described embodiments of the invention will be apparent to those skilled in the art, and it is to be understood that such modifications can be made without departing from the scope of the invention, if they are within the spirit and the tenor of the accompanying claims.

We claim:

1. A rocker arm of the cam-follower type having a metal body which comprises a stamped metal piece and a stamped metal strip positioned in substantially contiguous relationship and affixed together by braze metal, said piece having a rounded recess in an end portion thereof facing away from said stamped strip to receive a lifter post having an end on which said rocker arm can pivot, said end portion thereof having a hole extending therethrough communicating with said rounded recess, said piece having another end portion of inverted U-shaped configuration in transverse cross section forming an additional recess to receive an end of a valve stem, said strip and said piece having intermediate generally convex portions facing away from said recesses, said strip also having a truncated conical projection in an end portion thereof communicating with said hole and forming a reservoir facing away from said stamped piece, the other end portion of said stamped strip being of inverted U-shaped configuration in transverse cross section and being in telescoping, contiguous relationship with said another end portion of said stamped piece, said convex portion of said strip having a generally rectangular opening therein, the surface of said convex portion of said stamped piece which faces toward said strip being contiguous with edges of said rectagnular opening, with said rectangular opening forming a shallow recess with an adjacent surface of said convex portion of said piece, a long-wearing metal insert in said shallow recess to be engaged by a cam, and means affixing said metal insert to said adjacent surface in said shallow recess.

2. A rocker arm of the cam-follower type having a metal body which comprises a stamped metal piece and a stamped metal strip positioned in substantially contiguous, telescoping relationship and affixed together by braze metal, said stamped metal piece and said stamped metal strip being of substantially equal thickness, said stamped piece having a rounded recess in an end portion thereof facing away from said stamped strip to receive a lifter post having an end on which said rocker arm can pivot, said end portion of said piece having a hole extending therethrough communicating with said rounded recess, said piece having another end portion of inverted U-shaped configuration in transverse cross section forming an additional recess to receive an end of a valve stem, said piece having an intermediate generally convex portion facing away from said recesses, said convex portion having sides extending away from said stamped strip, said stamped strip having an opening at an end portion thereof communicating with said hole and forming an oil reservoir, the other end of said stamped strip being of inverted U-shaped configuration in transverse cross section and being in telescoping, contiguous relationship with said another end portion of said stamped piece, said another end portion of said piece and said other end of said strip having ends terminating near one another in a substantially common plane, said stamped strip having an intermediate generally convex portion facing away from said recesses and having sides extending in telescoping, contiguous relationship with the sides of said stamped piece, the edges of said stamped strip and the edges of said sides of said stamped piece terminating near one another, said convex portion of said stamped strip having a generally rectangular opening therethrough, said convex portion of said piece being contiguous with edges of said rectangular opening, with said rectangular opening forming a shallow recess with an adjacent surface of said convex portion of said stamped piece, a long-wearing metal insert in said shallow recess to be engaged by a cam, and means affixing said metal insert in said shallow recess.

3. A method of making a rocker arm of the cam-follower type comprising stamping a metal piece including forming a rounded recess in an end portion thereof to receive a lifter post having an end on which said rocker arm can pivot, forming a U-shaped configuation in another end portion of said body to produce an additional recess to receive an end of a valve stem, and forming a convex intermediate portion in said metal piece facing away from said recesses with sides extending away from said convex portion in the direction said recesses face, stamping a metal strip including forming an opening in an end portion of said strip in a position coinciding with said rounded recess to form an oil reservoir in said strip, forming another end of said metal strip with a U-shaped configuration corresponding with the U-shaped configuration of said metal piece, forming an intermediate convex portion in said metal strip with sides extending away from said convex portion of said metal strip, forming a rectangular opening through said convex portion of said metal strip, assembling said stamped strip and said stamped piece in telescoping relationship with the sides of said stamped strip extending over the sides of said stamped piece with the U-shaped configuration of said metal piece nesting in the U-shaped configuration of said metal strip, with the surface of the convex portion of said stamped strip which faces toward said stamped piece being in contiguous relationship with the surface of the convex portion of said stamped piece which faces toward said stamped strip, and with said rectangular opening forming a shallow recess with an adjacent surface of said convex portion of said stamped piece, brazing said stamped strip and said stamped piece together, positioning a wear insert in said shallow recess, and affixing said wear insert in said shallow recess.

* * * * *